United States Patent [19]

Christiansen et al.

[11] Patent Number: 4,523,132

[45] Date of Patent: Jun. 11, 1985

[54] CENTRALLY CONTROLLED LIGHTING INSTALLATION HAVING A PLURALITY OF INDIVIDUALLY SWITCHED LIGHT POINTS CENTRAL SWITCH ELEMENTS AND INDIVIDUAL LIGHT SWITCHES THEREFOR

[76] Inventors: Dieter Christiansen, Leipziger Strasse 47, Mettmann, Fed. Rep. of Germany, D-4020; Bernd Redies, Im Rottfeld 17, Düsseldorf, Fed. Rep. of Germany, D-4000

[21] Appl. No.: 615,710

[22] Filed: May 30, 1984

Related U.S. Application Data

[63] Continuation of Ser. No. 261,386, May 7, 1981, abandoned.

[30] Foreign Application Priority Data

May 17, 1980 [DE] Fed. Rep. of Germany ..... 3018948

[51] Int. Cl.[3] ..... H05B 37/00

[52] U.S. Cl. ..... 315/321; 307/38; 307/113; 307/147; 315/250; 315/294; 315/362

[58] Field of Search ..... 315/321, 294, 299, 362, 315/250; 307/114, 113, 140, 157, 38, 147

[56] References Cited

U.S. PATENT DOCUMENTS

| | | | |
|---|---|---|---|
| 1,453,555 | 5/1923 | Stack | 361/210 |
| 2,646,478 | 7/1953 | Euler et al. | 335/180 |
| 3,514,626 | 5/1970 | Platzer | 307/114 |
| 3,860,910 | 1/1975 | Hudson | 307/114 |
| 4,246,559 | 1/1981 | Budrose | 335/186 |

*Primary Examiner*—Harold Dixon

*Attorney, Agent, or Firm*—Harold L. Stowell

[57] ABSTRACT

This invention relates to a lighting system having a plurality of individual light points or groups of individual light points which may be controlled by means of a central switch element, acting on all individual light points, whereby the function of the individual light points (or groups of individual light points to be jointly connected) is maintained independent of the central control and the individual light points may be switched on and off individually and independently, this lighting system being installable in a most simple manner with the use of already installed two-wire cabling and without additional cabling or devices. The present invention also relates to the central switch element and to the individual light switches associated with the individual light points or groups of individual light points, in different embodiments.

10 Claims, 11 Drawing Figures

CENTRALLY CONTROLLED LIGHTING INSTALLATION HAVING A PLURALITY OF INDIVIDUALLY SWITCHED LIGHT POINTS CENTRAL SWITCH ELEMENTS AND INDIVIDUAL LIGHT SWITCHES THEREFOR

This is a continuation of application Ser. No. 261,386, filed May 7, 1981 now abandoned.

Lighting in comparatively large buildings, which involves a plurality of individual light points, is controlled automatically in many cases today by the artificial lighting being switched on or off, for example, when night falls or at sunrise. This is particularly appropriate in times of energy shortages, because the employee using the artificial light source does not often think in particular of switching off the lights and so the light source remains on, even when there is sufficient daylight in the place of work, or the light source cannot be individually switched off upon leaving the place of work before switching off by automatic operation. In offices, in which the energy requirement of the lighting may make up approximately 30% of the total energy requirement for the building, this may result in considerable and undesired costs.

The central automatic control of the lighting is effected, for example, by switch clocks set at specific times. As a result of the switching off operation, the circuit is permanently broken. However, the use of such switching systems has the disadvantage that weather conditions and changes in the intensity of daylight caused by the weather are not taken into account by the systems, so that when there is a dense covering of cloud after sunrise the lighting is switched off too early or when dense cloud is building up the artificial lighting is not turned on or it is turned on too late early in the evening. Switching systems of this type also only allow a central switching on or off of the complete installation.

There are also so-called "dimness switches", by which the artificial lighting is switched on or off depending on the actual intensity of daylight in a suitable manner by a current pulse released upon a specific light intensity. However, these systems also have the disadvantage that a control corresponding to the actual requirement of light in all parts of the building is impossible. The requirement for artificial lighting may vary quite considerably in the individual parts of the building, for example, depending on the aspect or on the distance from neighbouring houses and the height thereof or on the amount of trees in front of some of the windows of the building. This problem could, it is true, be alleviated by dividing the total lighting system into individual groups having a similar average light requirement and by switching the lighting on and off in each such section by a switch element controlled by natural light. However, the light requirement which varies considerably from person to person at the workplace cannot be considered either, so that people's health may also suffer to a considerable extend due to inadequate lighting, even with such a current-energy-saving central control of the lighting in buildings. In this case as well, all of the lighting plant (or sections thereof) may either be switched on or switched off, so that individual switching of the individual light point is again impossible. However, the arrangement of such control elements at each individual workplace in such buildings has been too expensive until the present time.

The object of this invention is to provide a lighting system having a plurality of individual light points which may be centrally controlled and in which each individual light point (or small groups of individual light points, such as the light points of an entire room) is simultaneously and individually switchable, so that even after general switching off of the lighting installation by the central control, individual light points (or groups of light points) may be switched on again or they may be switched off independently of the complete installation before the general switching off by the central automatic control. It is a particular object of the invention to provide such a lighting system which is operable with the already generally installed and therefore generally available two-wire cabling, so that additional cabling and supplementary devices are not necessary.

The centrally controlled lighting installation according to the invention having a plurality of individually-switchable individual light points or groups of individual light points is characterised in that a switch element having a normal switch position and a temporary adjustable, variable switch position is provided centrally in the circuit, i.e. between the power source and the first branch of the circuit to the individual light points connected in parallel, which switch element keeps the circuit closed in its normal switch position and the circuit is broken for a short time by operating the switch element, and a switch element which may be operated by a temporary current pulse is associated with each individual light point or groups of individual light points, the switch contact of this switch element being kept closed during the current passage and opening when there is a break in the circuit and remaining open even when the central switch-element is subsequently closed, without further intervention, and it is either:

(a) designed so that it may also be opened and closed mechanically from outside, or (b) designed so that it may also be closed mechanically from outside and in this design, another switch element is provided having a normal (continuous) switch position and a temporary adjustable, variable switch position and it is associated with this switch element and is connected in series thereto and it keeps the circuit closed in its normal switch position and the circuit is broken for a short time as a result of its operation, or (c) designed without mechanical means for operation from outside, as embodiments (a) and (b) but wherein a second switch element is provided having a normal switch position and a temporary adjustable, variable switch position, which second switch element is associated with this switch element operated by the temporary current pulse and is connected in series thereto, this second switch element keeping the circuit closed in its normal switch position and breaking the circuit for a short time as a result of its operation, and wherein a third switch element is provided having a normal switch position and a temporary adjustable, variable switch position, which third switch element is associated with the switch element operated by a temporary current pulse and is connected parallel to the switch contact of this switch element, this third switch element keeping its switch contact open in its normal switch position and its switch contact and thereby the circuit closed for a short time as a result of its operation even when the switch contact of the switch element which may be operated by the temporary current pulse is open.

The switch element which may be operated by a temporary current pulse is a magnetic switch in the preferred embodiment of the individual light switch according to the invention associated with the individual light points or groups of individual light points. Within the context of the present invention, the term "magnetic switch" is understood to mean a switch element having a switch contact and an electromagnet connected in series, which switch contact is closed and is kept closed when current flows through the electromagnet, e.g. by a lever arm which is then attracted by the electromagnet, and which is opened and is kept open when the current no longer flows through the electromagnet, e.g. by a spring acting on the switch contact or on the lever arm connected therewith or by a suitable three-dimensional arrangement or even by it inherent weight.

This preferred embodiment of the lighting installation according to the invention is characterised in that a switch element having a normal switch position and a temporary adjustable, variable switch position is provided centrally in the circuit, i.e. between the power source and the first branch of the circuit to the individual light points connected in parallel, which switch element keeps the circuit closed in its normal switch position and the circuit is broken for a short time when the switch element is operated and a magnetic switch is associated with each individual light point or groups of individual light points, the switch contact of the magnetic switch being kept closed during the current flow and opening when there is a break in the circuit and remaining open even when the central switch element is subsequently closed, without further intervention, and said magnetic switch is either:

(a) designed so that it may also be opened and closed mechanically from outside, or (b) designed so that it may also be closed mechanically from outside and in this design, another switch element having a normal switch position and a temporary adjustable variable switch position is provided, associated with the magnetic switch and connected in series thereto, which switch element keeps the circuit in its normal switch position and the circuit is broken for a short time when the switch element is operated, or (c) designed without mechanical means for operation from outside, as embodiments (a) and (b), but wherein a second switch element having a normal switch position and a temporary adjustable, variable switch position is provided which second switch element is associated with the magnetic switch and connected in series thereto, this second switch element keeping the circuit closed in its normal switch position and breaking the circuit for a short time when the switch element is operated, and wherein a third switch element having a normal switch position and a temporary adjustable, variable switch position is provided associated with the magnetic switch and connected parallel to the switch contact of the magnetic switch and connected in series to the electromagnet of the magnetic switch, this third switch element keeping its switch contact open in its normal switch position and when this third switch element is operated, its switch contact and thereby the circuit is closed for a short time even when the switch contact of the magnetic switch is open.

The lighting installation according to the invention is schematically illustrated and explained in the following drawings and circuit diagrams with respect to a preferred embodiment, but without being restricted thereto.

Figure 1:
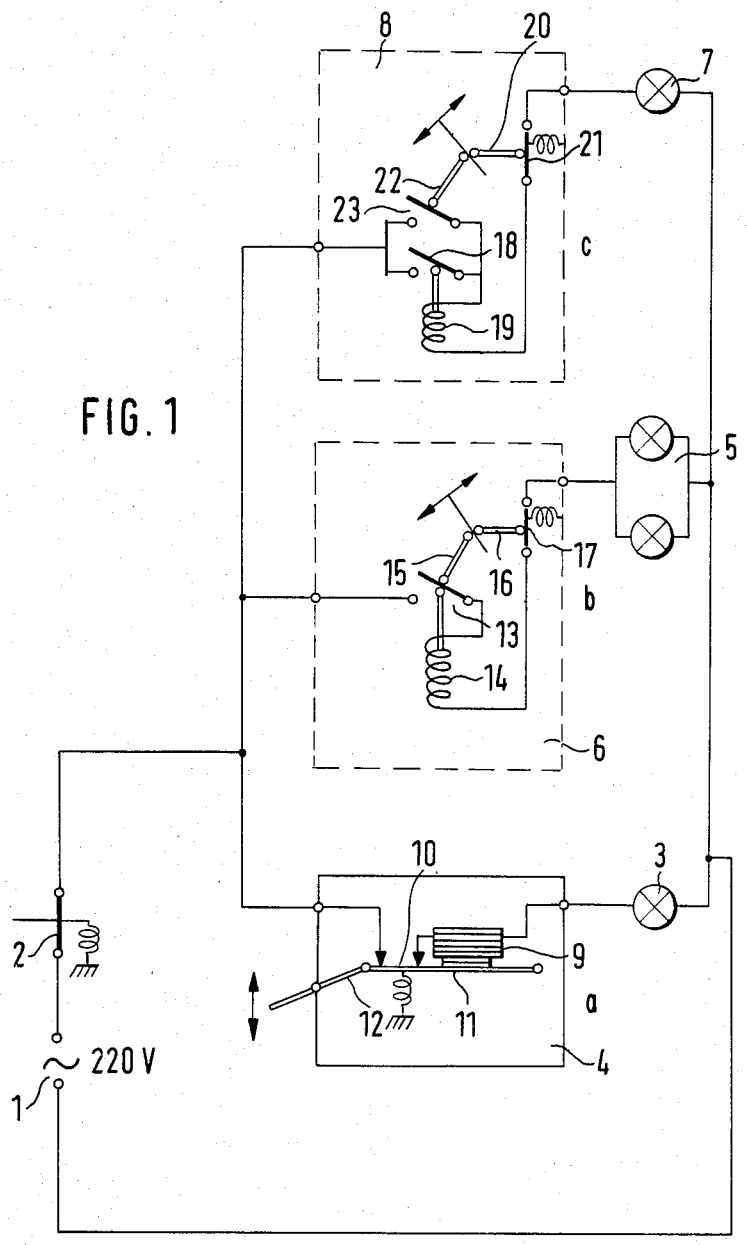
FIG. 1 is a schematic diagram of a central or master controller and three alternate embodiments of mechanical-electrical local switches to energize lamp loads.

The lighting installation illustrated in FIG. 1 with the power source 1 and the switch element 2 positioned centrally in the circuit has four individual light points, wherein individual switches 4, 6 and 8 provided with magnetic switches are associated with each of the individual light points 3 and 7 or with the group 5 of light points to be connected together, in the different embodiments of the lighting installation according to the invention. The individual switch 4 corresponds to embodiment (a), the individual switch 6 corresponds to embodiment (b) and the individual switch 8 corresponds to embodiment (c).

The central switch element 2 has a normal switch position and a temporary adjustable, variable switch position, whereby the switch contact is closed in its normal switch position, e.g. by a suitable spring provided in the switch element, and thereby the circuit of the lighting installation according to the invention is also kept closed, whereas as a result of operating the switch element, e.g. by pressure against the force of the spring, the switch contact and thereby the circuit of the lighting plant according to the invention may be broken for a short time.

In the embodiment (a) of the individual light switch 4 associated with the individual light point 3, the magnetic switch is not only designed such that it may be operated by the lever arm 11, which is attracted by the electromagnet 9, is positioned rotatably at one of its ends and simultaneously causes the contact closure of the switch contact 10 of the magnetic switch, but it is also designed so that it may be opened and closed mechanically from outside via the operating lever 12 which is rotatably secured on its other free end.

If, in embodiment (a) of the lighting installation according to the invention, the current is interrupted for a short time by operating the central switch 2, the electromagnet 9, due to the inherent weight of the lever arm 11 positioned thereunder, releases this arm 11, so that the switch contact 10 is opened and is kept open even when the central switch 2 returns to its closed normal switch position. If artificial light is required at the individual light point against the command of the central switching point 2, the switch contact 10 is closed by pressing in the operating lever 12 of this embodiment of the individual switch and it is kept closed due to the resulting flow of current through the electromagnet 9. However, if switching off of this individual light point is required or a switching off of the light point which is subsequently switched on again as described is required before the central switching off of the entire lighting installation, effected by operating the circuit element 2, the switch contact 10 is opened by pushing the operating lever 12 up, applying an adequate pressure against the attractive force of the electromagnet 9, so that the electromagnet loses its attractive force and the switch contact 10 is opened.

In the embodiment (b) of the lighting installation according to the invention, the magnetic switch is only designed so that it may also be closed mechanically from outside. On the frame of the individual switch 6 associated with the individual light point 5, the switch contact 13 of the magnetic switch may not only be operated by the electromagnet 14 and the lever arm 14*a* which may be attracted by the electromagnet 14, but the switch contact 13 may also be closed using the lever arm 15 which may be operated from outside the individual switch 6 by pressing in this lever arm 15. The switch element 16, 17 having a normal switch position and a temporary adjustable, variable switch position is also provided in the individual switch, is connected in series to the magnetic switch and which, like the central switch element 2 keeps its switch contact 17 and thereby the circuit closed in its normal switch position and when it is operated by pressing in the "Off" part of the operating switch, the switch contact 17 is broken for a short time via its operating lever 16 and thus the circuit is also broken for a short time.

If, as in the previously described case, the central switch 2 is opened for a short time, the current flow in the electromagnet 14 and thus the resulting attraction is terminated and the electromagnet 14, due to, for example, a spring acting on the lever arm of the magnetic switch, releases the attracted lever arm and the switch contact 13 of the magnetic switch is opened and is kept open as a result of this action. If the individual light point is to be switched on again against the central control command of the switch element 2, the switch contact 13 of the magnetic switch and thus the complete circuit is closed by pressing in this lever arm 15 and, due to the then restored attraction of the electromagnet 14, the switch contact 13 is kept closed. If the individual light point is then to be later switched off again, the circuit is broken for a short time by operating the switch element 16, 17 provided in the individual switch 6 and thus associated with the magnetic switch, so that the electromagnet 14 releases the lever arm of the magnetic switch and it re-opens its switch contact 13 and keeps it open. Thus, in the individual switch of the embodiment (b) of the lighting installation according to the invention, the switch contact 13 of the magnetic switch takes over the switching on operation, apart from keeping its contact closed, whereas the switching off operation is taken over by the switch element 16, 17 associated therewith. Since as is known, due to the closing or opening operation of switch contacts and the sparking caused by these operations, power peaks may occur, the magnet coil in embodiment (b) may optionally be provided with a lower capacity as compared to embodiment (a).

The embodiment (c) provides an even lower load for the magnetic switch, in which embodiment the switch contact 18 of the magnetic switch together with its magnet 19 only takes over the task of keeping the circuit closed. In addition to the switch element 20, 21 of the embodiment (b) connected in series to the magnetic switch, another switch element 22, 23 having a normal switch position and a temporary adjustable, variable switch position is provided which is connected parallel to the switch contact 18 of the magnetic switch and is connected in series to the magnet 19 of the magnetic switch and it keeps its switch contact 23 open in its normal switch position and its switch contact is closed for a short time when it is operated, so that the magnetic switch is designed to be operated from outside without any additional mechanical possibility. As a result of pressing in the operating lever 20 associated with the switch contact 21, the circuit is broken for a short time, whereas upon pressing the operating press lever 22 associated with the switch contact 23, the circuit is even closed when the switch contact 18 of the magnetic switch is open.

If, as in the previously mentioned examples, the central switch 2 is operated and a result of this, the circuit is broken for a short time, the switch contact 18 of the magnetic switch is opened, for example, due to a spring provided in the magnetic switch and holding its lever arm. If the individual light point is to be switched on again against the command of the central switching point 2, the switch contact 23 is closed for a short time by actuating the operating lever 22, designed in this case as a rocker switch, and the switch contact 18 of the magnetic switch is closed and is kept closed, due to the current flow through the electromagnet of the magnetic switch. If the individual light point is then to be switched off again independently of the central control, the switch contact 21 and thus the circuit for the individual light switch 7 is broken for a short time by actuating the operating lever 20 and thus, the switch contact 18 of the magnetic switch associated therewith is also reopened.

Limited by the two-wire design and thus by the load switching of the magnet coil of the magnetic switch and the considerable load variations in the circuit of such lighting installations, the magnet of the magnetic switch may be charged with different loads such that by adjusting the design of the coil according to the load peak, the magnet of the magnetic switch is not yet energised enough in the lower load range to reliably close the switch contact of the magnetic switch and to also keep it closed. However, if the coil of the magnetic switch is designed such that the switch contact of the magnetic switch is closed reliably even in the lower load range and is kept closed with an adequate strength, there is a danger of considerable overheating of the magnet and thus a danger of fire in the building having such lighting installations where there is a load in the range of the peaks or even in the middle range of the load variations. In addition thereto, magnetic switches of this type have to be so large that it is no longer possible to house the individual switches produced therewith in conventional sized counter-sinkable wall boxes. However, it is a particular object of an embodiment of the present invention to design the individual light points or groups of individual light points to be able to be switched on and off while using available two-wire lighting installations with conventionally-sized connection boxes and without additional devices, i.e. exchanging the old switches for the new individual switches in lighting installations controlled centrally by a current pulse.

Figure 3:
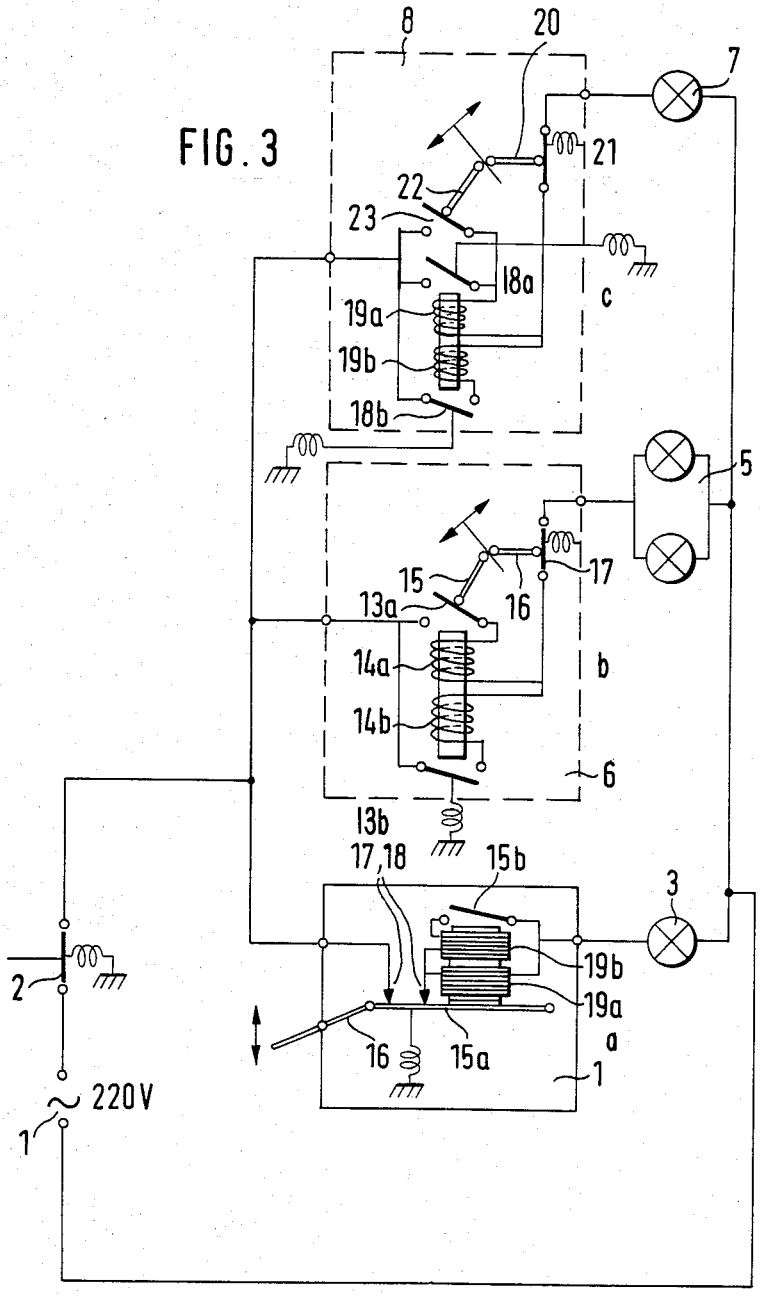
FIG. 3 is a modification of FIG. 1.

Another embodiment of the lighting installation according to the invention and of its individual light switches relates to the magnetic switches 9, 10, 11, 12 or 13, 14, 15, or 18, 19 of the individual switches. It is schematically illustrated in FIG. 3, for the magnetic switches 13, 14, 15 or 18, 19 of the individual switches (see also FIG. 10 and 11). This applies accordingly to the magnetic switch 9, 10, 11, 12 of embodiment (a) (see also FIG. 9).

The embodiment, which is improved with respect to heat control and is therefore particularly preferred, is characterised in that the magnetic switch is designed in the form of a double magnet having a common magnet core and two connected magnet coils 9*a* and 9*b* connected in parallel or 14*a* and 14*b* or 19*a* and 19*b* having respectively a switch contact 11*a* and 11*b* or 13*a* and 13*b* or 18*a* and 18*b* operated by the respective magnetic switch and connected in series to each magnet coil. One magnet coil is designed for low magnet power and it closes its contact when energised and keeps it closed, whereas the other coil and optionally also the contact lever of the switch contact associated with this coil is designed such that its switch contact only closes the contact and keeps it closed at a current intensity which corresponds to at least approximately three times, preferably four times, the minimum current intensity at which the magnetic switch with the magnet coil for low magnet power closes the switch contact associated therewith and keeps it closed.

According to a preferred embodiment, the two magnet coils of the double magnet connected in parallel to each other are wound one upon the other over a common magnet core.

It is most particularly preferred for the common magnet core of the double magnet to be formed from sheets mounted in parallel.

In these preferred embodiments with double magnet, the variation range of the magnet power due to the load switching of the magnet coil is thus subdivided so that it is not necessary to construe the magnet coil to meet the highest magnet power demand with in this variation range in order to avoid the generation of an excessive amount of heat. The exact division of the total power range is appropriately effected in that the magnet coil designed for low magnet power covers approximately one third of the total variation range and approximately two thirds of the range is controlled by the magnet coil designed for greater magnet power. In this operation, the best division is to be established empirically for the respective design of the double magnet and switch contacts.

Instead of the magnetic switch, other switch elements which may be operated by a temporary current pulse, such as relays controlled by a transistor, may also be used, in particular in the embodiment (c) of the lighting installation according to the invention, as long as the relay is opened by this current pulse retransmitted via the mains of the lighting installation and may be opened and closed according to the individual embodiments from outside, and also separately for each individual light point, whether it is fully mechanical, according to embodiment (a), partly mechanical according to embodiment (b) or fully non-mechanical by suitable pulse transmitters associated with the individual light points according to embodiment (c). However, the switch element 2 must then also be replaced by a suitable central pulse transmitter. The embodiment illustrated, in which the control pulse is provided by a temporary interruption in the current, allows, however, a particularly simple design and is therefore preferable.

Figure 2:
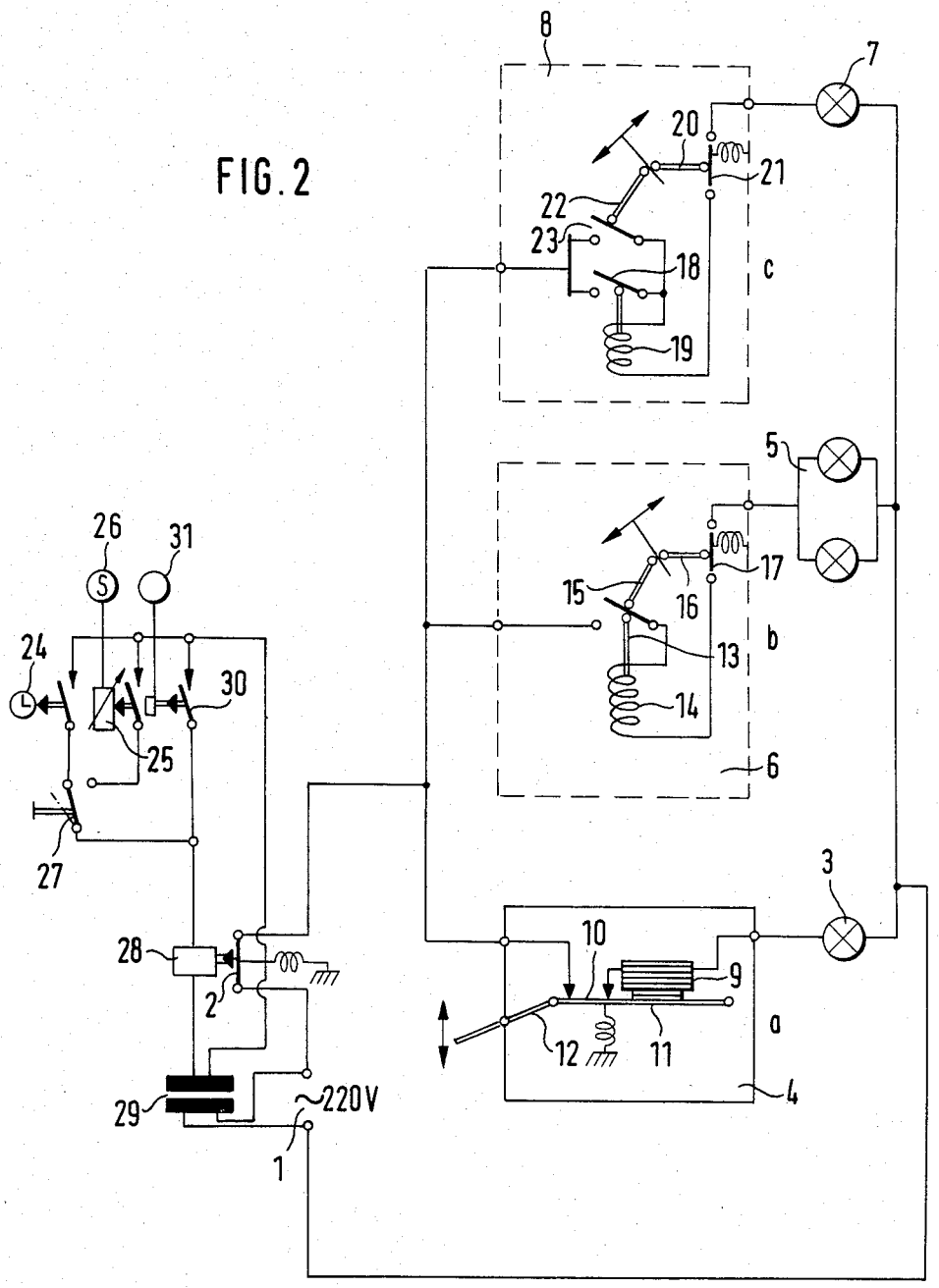
FIG. 2 is a schematic with a specific master-clock controller.

The central switch element 2 may be operated manually or using suitable control devices. According to a particularly preferred embodiment, the central switch element 2 constitutes a switch element which may be operated by the energising of a magnet coil and this switch element is controlled both by a conventional switch clock having at least two adjustable switch positions for actuating the switch of the switch clock as well as by a dimness switch connected in parallel thereto and optionally adjustable with respect to the light sensitivity. A control element of this type is schematically illustrated in FIG. 2 or the drawings as well as being illustrated as a separable part of the lighting installation in FIGS. 4 and 5. This control element has a conventional switch clock 24 with a conventional seven day/24 hour program and has at least two adjustable switch settings for actuating the switch of the switch clock 24 designed as a brush contact, a dimness switch 25 which is optionally adjustable with respect to the light sensitivity with a switch designed as a brush contact and having a separate light sensor 26 which may be connected via the terminal 32, a changeover switch 27 for connecting a first terminal of the switch contact with selectively either the one or other second terminal of the switch contact or with both terminals, a switch 2 which may be operated by exciting a magnet coil 28 and having a normal switch position while closing its switch contact and a variable switch position which may be adjusted for a short time by operating the switch, while opening the switch contact. The mains voltage of the power source 1 is transformed by the transformer 29 to the control voltage of the control device for the central switch element 2.

According to a preferred embodiment, the control device also has a switch 30 on the frame whose switch contact is connected in parallel to the switches of the switch clock 24 and the dimness switch 25 and whose switch lever may be actuated mechanically or electromagnetically or the like, for example by a ripple central signal provided by an external signal transmitter 31.

Thus, the lighting installation according to the invention may be set for light or time-control or for both together by the change-over switch 27, so that the control may be effected both by the intensity of daylight as well as by the switch clock, so that, for example, in summer with a specific daylight intensity, the first switching off is effected centrally and a second control switching off may be carried out at a later time. Therefore, an extremely versatile control of the lighting installation according to the invention, being dependent on numerous conditions is possible with this control device.

Protection is not only claimed for the complete lighting installation of FIGS. 1 to 3, but also for the control element according to FIG. 2, such as the individual light switches in the individual embodiments which may be produced separately and may be assembled into the lighting installations according to the invention using available two-wire cabling of hitherto conventional lighting plants.

Figure 4:
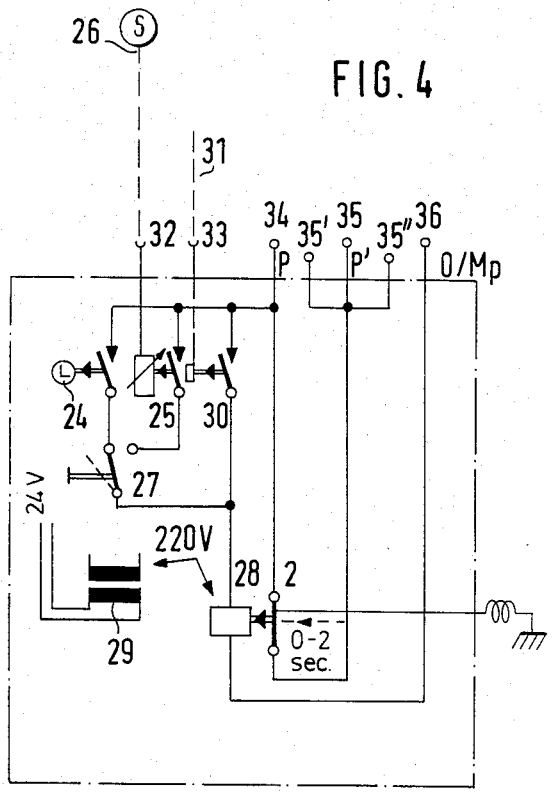
FIG. 4 is a schematic of the master controller.
Figure 5:
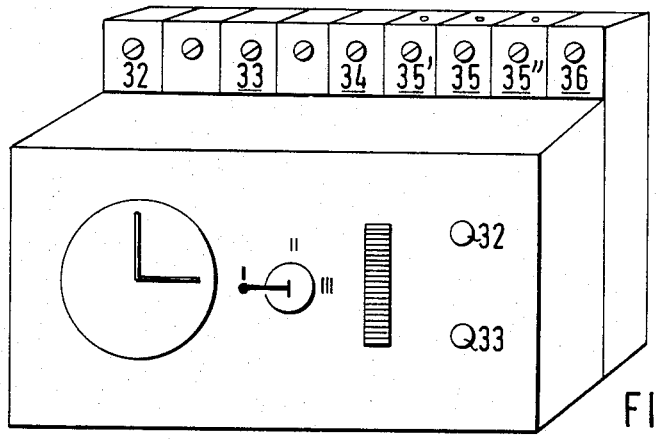
FIG. 5 is a top view of the master controller.
Figure 7:
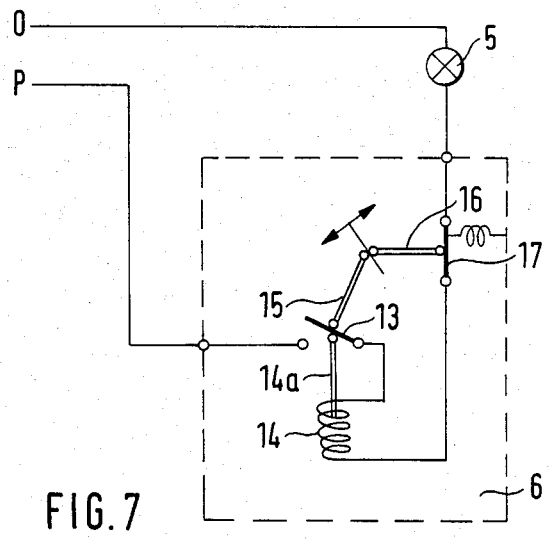
FIGS. 6–8 show the local switches of FIG. 1 switches of FIG. 1 separately.
Figure 6:
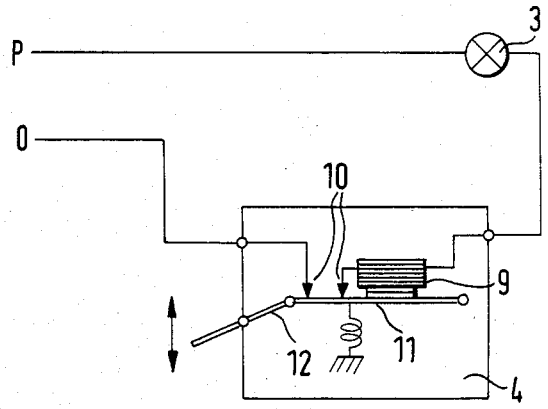
Figure 8:
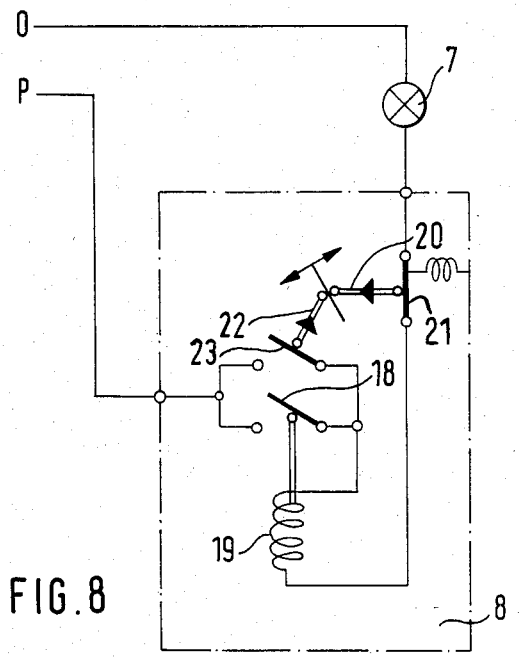
Figure 9:
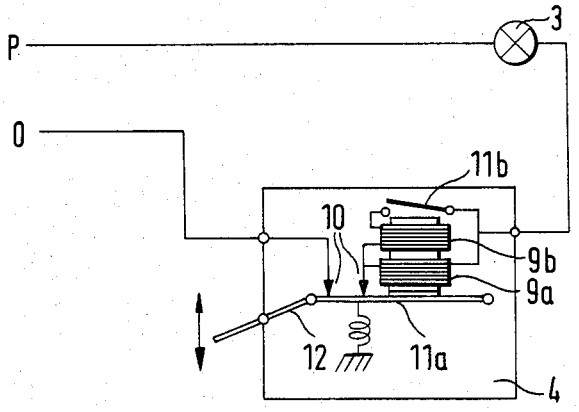
FIGS. 9–11 show the local switches of FIG. 3 separately.
Figure 10:
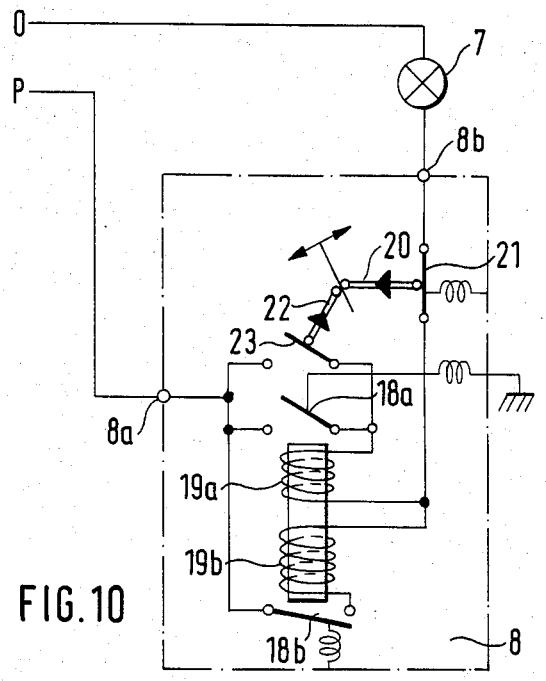
Figure 11:
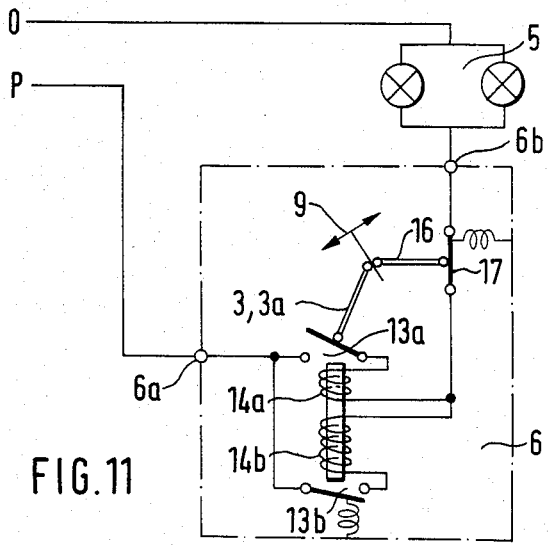

FIG. 4 shows a circuit diagram of the control element separate from the rest of the lighting installation, FIG. 5 shows a top view of such a control element, FIGS. 6 to 8 show the individual light switches 4, 6 and 8 in the circuit diagram of FIG. 1 schematically separate from the rest of the lighting installation in the preferred embodiment, FIGS. 9 to 11 show the individual light switches 4, 6 and 8 in the embodiment of FIG. 3. Thus, FIG. 9 shows the individual light switch assigned to the lighting point 3 of FIG. 3, FIG. 11 shows the individual light switch assigned to the group 5 of lighting points of FIG. 3 and FIG. 10 shows the individual light switch assigned to the lighting point 7 of FIG. 3. FIG. 6 to 8 show in the same way the individual light switches assigned to the lighting points 3, 5 and 7 of FIGS. 1 and 2.

What we claim is:

1. In an electric power system for a house or the like, where there are a plurality of individual light sources at various locations and there is a two-wire cabling for power delivery, a system which provides for individual operation of said light sources at their related locations for both activation and deactivation of related light sources, and also for deactivation of said light sources from a master location without interference with subsequent individual activation and deactivation of said light sources, said system comprising;

(a) a plurality of individual switch assemblies, each of which is operatively connected to at least a related one of said light sources for individual operation thereof, each individual switch assembly comprising:

(1) a first on-off switch kept in its closed position by a magnet coil where power is delivered to said light source and kept in its open position where power is not delivered to said light source, (2) means to operate said first on-off switch independent from the force effected by the magnet coil to close it, to selectively (aa) close and open said first on-off switch mechanically from outside the individual switch assembly and (bb) close said first on-off switch mechanically from outside the individual switch assembly and to open said first on-off switch electrically by means of a second normally kept closed on-off switch between said magnet coil and one of the power outlets of said individual switch assembly and (cc) open said first on-off switch electrically by said second on-off switch and to close said first on-off switch electrically by third normally kept open on-off switch arranged parallel to said first on-off switch, and (b) master switch means which is normally kept in its closed switch position and which may be opened for momentary power interruption of the electrical power system, resulting in an opening of said first on-off switch of each individual switch assembly.

2. The system as recited in claim 1, wherein the first on-off switch together with the magnet coil operating it for closure, comprising a double magnet having a common magnet core, two magnet coils connected in parallel and each switch contact operated for closure by the respective magnetic coil connected in series to each magnet coil, one of the two magnet coils being designed for low magnet power and closing its switch contact and keeping it closed where power is delivered to the system while the other coil being designed such that it only closes its switch contact and keeps it closed when there is a current intensity which corresponds to at least approximately three times the minimum current intensity at which the magnet coil for low magnet power closes the switch contact associated therewith and keeps it closed.

3. The system as recited in claim 2, wherein the magnet coils of the double magnet connected in parallel to each other are wound one upon the other over the common magnet core.

4. The system as recited in claim 3, wherein the common magnet core of the double magnet is formed from sheets packed in parallel.

5. The system as recited in claim 2, wherein the common magnet core of the double magnet is formed from sheets packed in parallel.

6. The system as recited in claim 1, wherein the master switch means is a switch which may be operated by the energizing of a magnet coil, and it may be energized by a conventional switch clock having at least two adjustable switch positions for actuating the switch of the switch clock.

7. An individual switch assembly useful in the system as recited in claim 1, wherein it has a first switch and an electromagnet which are connected in series to each other, whereby the first switch may be closed and kept closed by the electromagnet when electric current flows through the electromagnet and it may be closed or opened mechanically from outside the individual switch assembly.

8. An individual switch assembly useful in a system as recited in claim 1, comprising two power outlet points and an electrical connection there between, a first switch having an electromagnet and which first switch is closed when an electrical current runs through its electromagnet and wherein there is provided a second switch and a third switch operated independently of each other, said third switch being connnected in parallel to the first switch.

9. The individual light assembly according to claim 8, wherein the first switch has a switch contact to be actuated by its magnetic coil when current flows through the magnet coil and is kept closed as long as current flows there through and is opened by a spring and is kept open when there is no current flowing through its magnet coil.

10. The individual switch assembly according to claim 9, wherein the second switch and the third switch combined in the form of a known rocker switch having a central neutral switch position whereby in the central neutral switch position, the second switch keeps its contact and thereby the electrical connection closed and it opens these for a short time upon actuation by the rocker switch, whereas the third switch keeps the contact open and closes it for a short time upon actuation of the rocker switch.

* * * * *